US010093498B2

(12) United States Patent
Ohno

(10) Patent No.: US 10,093,498 B2
(45) **Date of Patent: *Oct. 9, 2018**

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Masahiro Ohno, Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/671,236

(22) Filed: Aug. 8, 2017

(65) Prior Publication Data

US 2017/0334671 A1 Nov. 23, 2017

Related U.S. Application Data

(63) Continuation of application No. 14/858,139, filed on Sep. 18, 2015, now Pat. No. 9,834,397.

(51) Int. Cl.

| | |
|---|---|
| ***B65H 5/06*** | (2006.01) |
| ***B65H 3/46*** | (2006.01) |
| ***B65H 1/26*** | (2006.01) |
| ***B65H 1/04*** | (2006.01) |

(Continued)

(52) U.S. Cl.

CPC ..... *B65H 5/062* (2013.01); *B65H 1/04* (2013.01); *B65H 1/14* (2013.01); *B65H 1/266* (2013.01);

(Continued)

(58) Field of Classification Search

CPC ... B65H 1/00; B65H 1/04; B65H 1/08; B65H 3/06; B65H 2405/311; B65H 5/062;

(Continued)

(56) References Cited

U.S. PATENT DOCUMENTS 3,767,188 A 10/1973 Rosenberg, Jr. et al.
5,137,269 A 8/1992 Yamamoto (Continued)

FOREIGN PATENT DOCUMENTS

JP 2005-320109 11/2005

OTHER PUBLICATIONS

U.S. Appl. No. 15/801,378, filed Nov. 2, 2017.
Non-Final Office Action for U.S. Appl. No. 14/858,139 dated Aug. 22, 2016.
Final Office Action for U.S. Appl. No. 14/858,139 dated Jan. 13, 2017.

*Primary Examiner* — David H Bollinger
(74) *Attorney, Agent, or Firm* — Amin, Turocy & Watson LLP

(57) ABSTRACT

In accordance with one embodiment, an image forming apparatus comprises a cassette for paper feed configured to contain a tray capable of stacking papers stored in a packaging member of which one end portion is opened, together with the packaging member; a paper feed section configured to contain a pickup roller which picks up the papers stored in the packaging member from the opened end portion of the packaging member; a regulating member configured to regulate that the packaging member is conveyed from the tray of the cassette; and a protrusion configured to be formed and protrude from the regulating member to cover the opened end portion of the packaging member.

10 Claims, 8 Drawing Sheets

(51) Int. Cl.
*B65H 7/14* (2006.01)
*B65H 3/06* (2006.01)
*B65H 1/14* (2006.01)

(52) U.S. Cl.
CPC ..... *B65H 3/06* (2013.01); *B65H 3/46* (2013.01); *B65H 7/14* (2013.01); *B65H 2405/1117* (2013.01); *B65H 2405/311* (2013.01)

(58) Field of Classification Search
CPC . B65H 1/266; B65H 3/46; B65H 1/14; B65H 7/14; B65H 2405/1117
USPC ..... 271/117, 145, 147
See application file for complete search history.

(56) References Cited

U.S. PATENT DOCUMENTS

| | | | |
|---|---|---|---|
| 5,228,677 | A | 7/1993 | Asakawa |
| 6,227,732 | B1 | 5/2001 | Higuchi et al. |
| 6,357,739 | B2 | 3/2002 | Sasaki et al. |
| 6,546,210 | B1 | 4/2003 | Nakamura |
| 6,598,795 | B1 | 7/2003 | Prenn |
| 2002/0136575 | A1 | 9/2002 | Cornelius |
| 2006/0165468 | A1 | 7/2006 | Yamamoto et al. |
| 2006/0191643 | A1 | 8/2006 | Haug |
| 2007/0126172 | A1 | 6/2007 | Nakamura et al. |
| 2009/0194448 | A1 | 8/2009 | Horiuchi et al. |
| 2012/0126475 | A1 | 5/2012 | Shin et al. |
| 2016/0145060 | A1 | 5/2016 | Ohno |

IMAGE FORMING APPARATUS

CROSS-REFERENCE TO RELATED APPLICATIONS

This application is a Continuation of application Ser. No. 14/858,139 filed on Sep. 18, 2015, the entire contents of which are incorporated herein by reference.

FIELD

Embodiments described herein relate generally to an image forming apparatus such as a copier and the like in which papers are placed in a cassette for paper feed in a state in which the papers are stored in a packaging member and the papers can be taken out.

BACKGROUND

Conventionally, the image forming apparatus conveys a paper taken out from a cassette for paper feed to an image forming section and then forms an image on the paper. In order to take out the paper from the cassette, the cassette has a pickup roller and a paper feed roller.

Incidentally, conventionally, papers are packaged in a packaging member such as a wrapping paper and the like. Thus, in a case of stacking the papers in the cassette, it is general to take out a paper from the packaging member and set the only paper in the cassette. In a case of stacking the papers in the cassette, it is necessary to set the papers in a state in which the papers are aligned by a side guide and an end side.

If the paper is not aligned, in a case of a set failure, the image printed on the paper is deviated. Further, in a case of the set failure, a front-end position of the paper is deviated, and a lateral deviation and a slope (skew) may occur. Moreover, in a case of the set failure, a paper feeding error such as a paper jam and a conveyance failure may occur.

One bundle of papers packaged in the packaging member is generally packaged at a unit of 250 sheets or 500 sheets. Therefore, when a paper bundle is taken out from the packaging member, the papers are disturbed and then the paper bundle is collapsed.

It is necessary to align the collapsed papers; however, if the number of papers is 250 sheets or 500 sheets, the papers can not be aligned well. The paper bundle in a state in which the papers are not aligned may be set in the cassette. If the paper bundle in a state in which the papers are not aligned is set, the deviation of the image at the time of printing, the deviation of the front-end position of the paper, the lateral deviation of the paper and the slope (skew) occur.

In a state of storing the papers in the packaging member as it is, it is considered to set the papers in the cassette. For example, one part of the packaging member is broken along the perforation, and the end portion of the paper out of the packaging member is picked up by pickup roller and conveyed. However, in a case of setting the paper with the packaging member in the cassette, it is afraid that the conveyance failure occurs. The packaging member may be caught on a member in the cassette.

DETAILED DESCRIPTION

Figure 1:
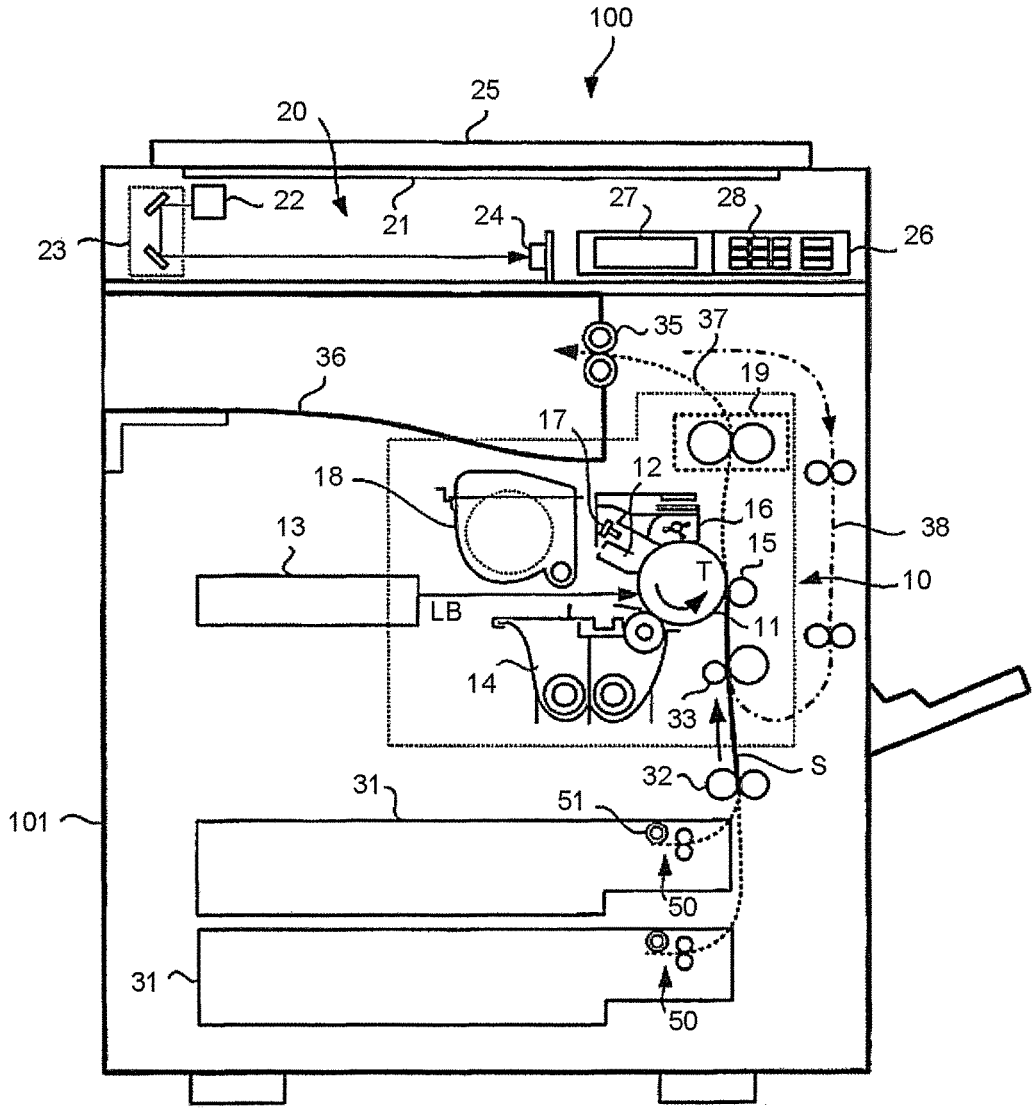
FIG. 1 is a diagram of an image forming apparatus according to an embodiment.

In accordance with one embodiment according to one embodiment, an image forming apparatus includes a cassette for paper feed configured to contain a tray capable of stacking papers stored in a packaging member of which one end portion is opened, together with the packaging member; a paper feed section configured to contain a pickup roller which picks up the papers stored in the packaging member from the opened end portion of the packaging member; a driving section configured to lift the tray of the cassette to the pickup roller side according to the reduction of the remaining amount of papers stacked on the tray of the cassette; a regulating member configured to regulate that the packaging member is conveyed from the tray of the cassette; a protrusion configured to be formed on the regulating member and protrude from the opened end portion of the packaging member; and an image forming section configured to form an image on the paper conveyed by the paper feed section.

Hereinafter, according to the embodiment, the image forming apparatus is described in detail with reference to the accompanying draws. Further, the same components in each figure are applied with the same reference numerals.

(First Embodiment)

FIG. 1 is a diagram of the image forming apparatus according to one embodiment. In FIG. 1, an image forming apparatus 100 is a copier constituted by an electrophotographic type. In addition to the copier, the image forming apparatus 100 may be a printer, an MFP (Multi-Function Peripheral) and the like. The copier is exemplified in the following description.

A printer section 10 is arranged at the centre of the image forming apparatus (copier) 100. The printer section 10 constitutes an image forming section. The printer section 10 is equipped with a rotatable photoconductive drum 11. The photoconductive drum 11, which is an image carrier, has an OPC (Organic Photo Conductor) at the outer peripheral surface thereof. The photoconductive drum 11 is irradiated by the light in a state in which the photoconductive drum 11 is given with a predetermined potential. The potential of an area where the photoconductive drum 11 is irradiated by the light changes. The photoconductive drum 11 is held at a predetermined time by taking the change of potential as an electrostatic latent image.

Around the photoconductive drum 11, a charging charger 12, an exposure unit 13, a developer 14, a transfer roller 15, a drum cleaner 16, a charge removing LED 17 are arranged along a rotation direction T of the photoconductive drum 11.

The charging charger 12 charges the surface of the photoconductive drum 11 to a predetermined potential. The exposure unit 13 emits a laser beam LB to the photoconductive drum 11 to expose it. The photoconductive drum 11 forms the electrostatic latent image at the surface thereof through the exposure. The emission intensity of the laser beam LB changes according to the density of the image.

The developer 14 stores a two-component developing agent consisting of a carrier and a toner. The developing agent is supplied to the surface of the photoconductive drum 11 from the developer 14, and then the electrostatic latent image of the photoconductive drum 11 is developed. The electrostatic latent image of the surface of the photoconductive drum 11 is formed with a visualized toner image. The transfer roller 15 applies a predetermined potential on a paper S serving as a recording medium. The transfer roller 15 transfers the toner image on the photoconductive drum 11 to the paper S.

The drum cleaner 16 removes a residual toner fixed at the surface of the photoconductive drum 11 to collect it. The charge removing LED 17 removes a residual charge of the photoconductive drum 11. A fixing device 19 is arranged at the downstream of the transfer roller 15. The fixing device 19 heats and pressures the paper S at a predetermined temperature and then conveys it. The toner image is fixed on the paper S by the fixing device 19

A toner cartridge 18 storing the toner is arranged at the upside of the developer 14. If the toner in the developer 14 is consumed, the toner is replenished to the developer 14 from the toner cartridge 18.

On the other hand, a scanner section 20 is arranged at the upper portion of the image forming apparatus 100. The scanner section 20 includes a light source 22, a reflecting mirror 23 and an image sensor 24. The light source 22 irradiates a document placed on a document placing table 21 with the light. The reflecting mirror 23 reflects the light reflected from the document and guides the reflected light to the image sensor 24. The image sensor 24 receives the reflected light from the reflecting mirror 23.

A document cover 25 is arranged at the upper portion of the document placing table 21 in an openable manner. An operation panel 26 is arranged at the upper portion of a main body 101 of the image forming apparatus 100. The operation panel 26 has an operation key 28 and a display section 27 of a touch panel format.

A cassette for paper feed 31 is arranged at the lower portion of the main body 101. The cassette 31 may be stored in the main body 101. The cassette 31 may be multiply arranged according to the paper size. The paper S in the cassette 31 stored in the main body 101 is picked up by a pickup roller 51.

The paper S picked up by the pickup roller 51 is guided to the transfer roller 15 by a conveyance roller 32 and a resist roller 33. The pickup roller 51 picks up the paper S in the cassette for paper feed 31 one by one. The conveyance roller 32 and the resist roller 33 are rotated at a predetermined timing to align the position of the paper S and the toner image being formed on the photoconductive drum 11. The conveyance roller 32 and the resist roller 33 convey the paper S to a transfer position. The paper S passing through the transfer roller 15 is conveyed to the fixing device 19. The paper S passing through the fixing device 19 is discharged to a paper discharge tray 36 by a discharge roller 35.

In a case in which the paper S is subjected to a simplex printing, the paper S is conveyed from the resist roller 33 to the transfer roller 15. The paper S is conveyed from the transfer roller 15 to the discharge roller 35 through the fixing device 19 via a conveyance path 37. Further, a reversal conveyance path 38 is arranged to be used at the time of carrying out a duplex printing. When carrying out the duplex printing, the paper S is temporarily conveyed from the discharge roller 35 to the paper discharge tray 36. And then, the paper S is switched back to be conveyed to the reversal conveyance path 38. The reversal conveyance path 38, which has a plurality of conveyance rollers, reverses the paper S and guides the paper S to the resist roller 33.

In the image forming apparatus 100 described above, during the image formation, the document on the document placing table 21 is irradiated by the light from the light source 22. The light source 22 and the reflecting mirror 23 move for reading the document. The light from the light source 22 is reflected by the document. The light reflected by the document enters the image sensor 24 through the reflecting mirror 23. Then, the image sensor 24 reads a document image based on the entered light. Based on the information read by the image sensor 24 or the image information supplied from an external device such as a PC (Personal Computer) and the like, the laser beam LB is output from the exposure unit 13.

The surface of the photoconductive drum 11 is irradiated by the laser beam LB. The surface of the photoconductive drum 11 is charged to negative polarity by the charging charger 12. The photoconductive drum 11 is exposed through emitting the laser beam LB from the exposure unit 13 to the photoconductive drum 11. Through the exposure, the electrostatic latent image is formed on the surface of the photoconductive drum 11.

If the paper S picked up from the cassette 31 is conveyed, the toner image on the photoconductive drum 11 is transferred to the paper S by the transfer roller 15. The paper S to which the toner image is transferred is conveyed to the fixing device 19. The paper S is heated and pressured by the fixing device 19, and then the image is fixed on the paper S. The paper S on which the image is fixed is discharged to the paper discharge tray 36 through the paper discharge roller 35.

Figure 2:
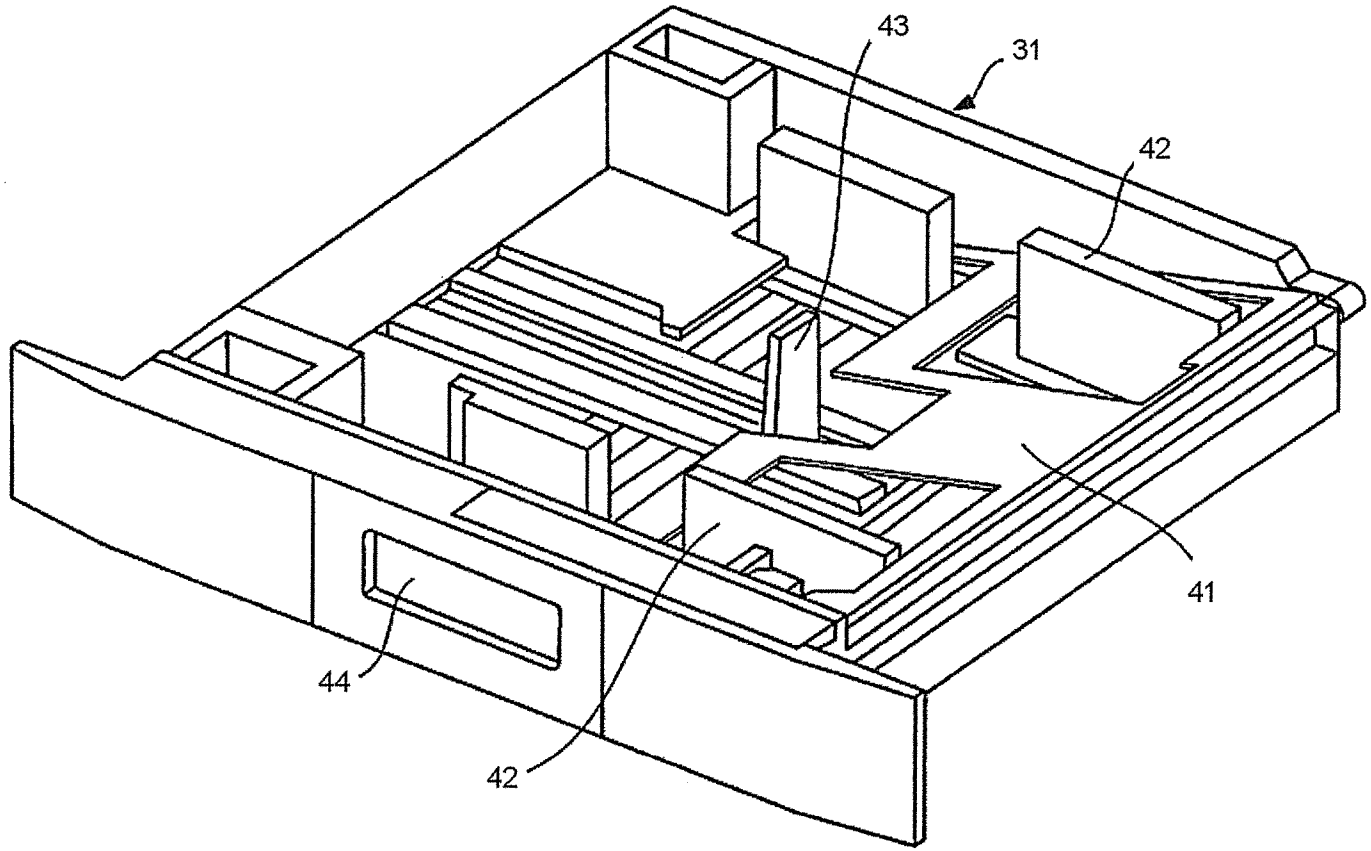
FIG. 2 is a perspective view illustrating an example of a cassette for paper feed according to the embodiment.

FIG. 2 is a perspective view illustrating the cassette for paper feed 31. The cassette 31 has a tray 41 for stacking the paper S. The tray 41 is inclined at an angle. A side guide 42 for aligning two sides of the paper S is arranged inside the tray 41. An end guide 43 for aligning the rear end portion of the paper S is arranged inside the tray 41. The cassette 31 is equipped with a handle 44 for taking out the cassette 31 from the main body 101 of the image forming apparatus 100. The end guide 43 can move according to the paper size.

Figure 3:
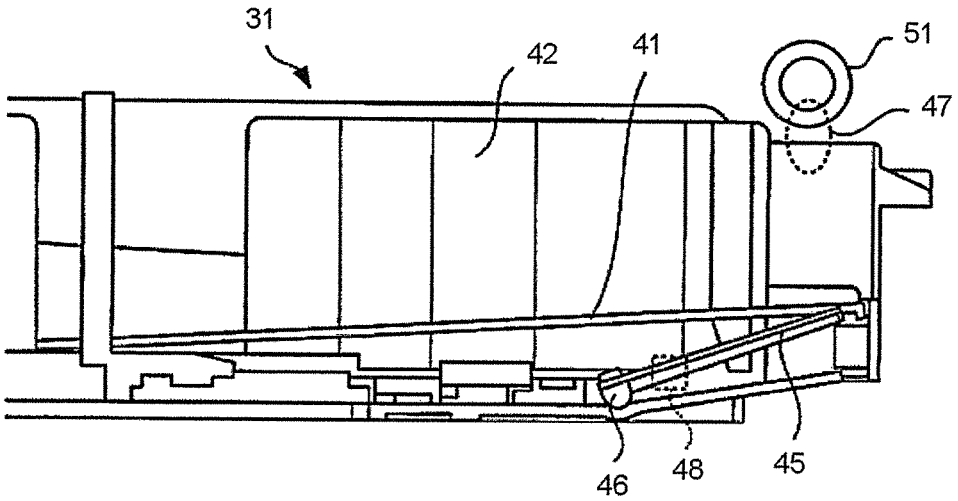
FIG. 3 is a side view of the cassette before papers are stacked according to the embodiment.
Figure 4:
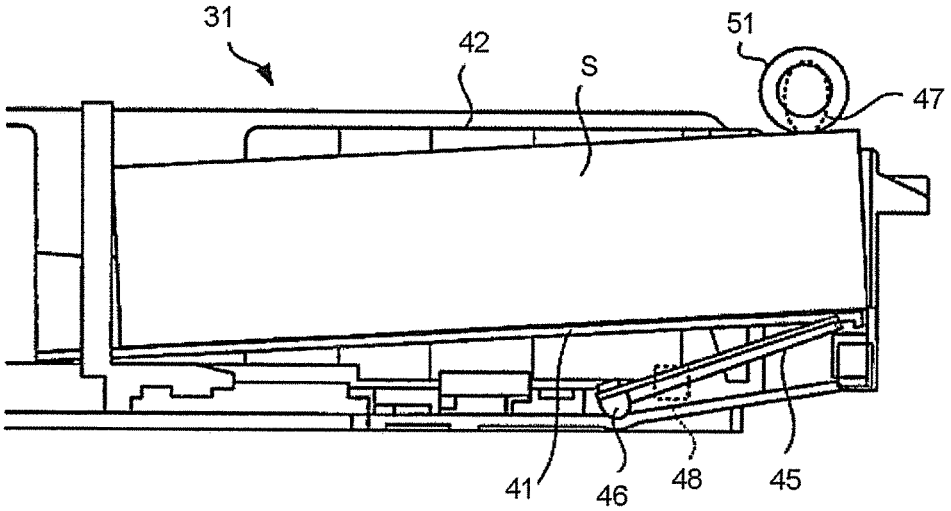
FIG. 4 is a side view of the cassette after the papers are stacked according to the embodiment.

FIG. 3 and FIG. 4 are side views of the cassette 31. FIG. 3 illustrates a state before stacking the paper S, and FIG. 4 illustrates a state after stacking the paper S. In FIG. 3, the tray 41 arranged inside the cassette 31 is in a lowered and fixed position. A lever 45 for lifting the tray 41 is arranged at the lower side of the tray. The lever 45 is rotated by taking a shaft 46 as a fulcrum and lifts one end of the tray 41.

The lever 45, for example, is combined with a driving section 48 including a motor, and is rotated by the driving section 48. If the lever 45 is rotated to lift one end of the tray 41, the tray 41 is rotated by taking the other end as a fulcrum. If the one end of the tray 41 is lifted, top surface of the papers S stacked on the tray 41 is contacted with the pickup roller 51. As the remaining amount of the papers S stacked on the tray 41 is reduced, one end of the tray 41 is lifted, and the paper of the top surface is always contacted with the pickup roller 51.

An empty sensor 47 is arranged nearby the pickup roller 51 of the cassette 31. The empty sensor 47 detects that there is no paper on the tray 41. For example, there is a hole (not shown) on the tray, and light source and the empty sensor 47 are arranged centering on the hole. In a case in which the empty sensor 47 detects the light from the light source passing through the hole, the empty sensor 47 detects there is no paper on the tray 41. When the paper S is on the tray 41, the hole arranged on the tray 41 is blocked by the papers. Therefore, the light from the light source does not transmit. As a result, the empty sensor 47 detects there are papers on the tray 41.

When there is no paper on the tray 41, the cassette 31 is drawn out with the handle 44 from the main body 101. By drawing out the cassette 31, the lever 45 deviates the combination with the driving section 48. Thus, the lever 45 is turned into a free state with respect to the driving section 48, and falls to a fixed position through a self-weight. Alternatively, if there is no paper on the tray 41, the lever 45 is rotated in a reverse direction by the driving section 48, and the tray 41 may be lowered.

Figure 5:
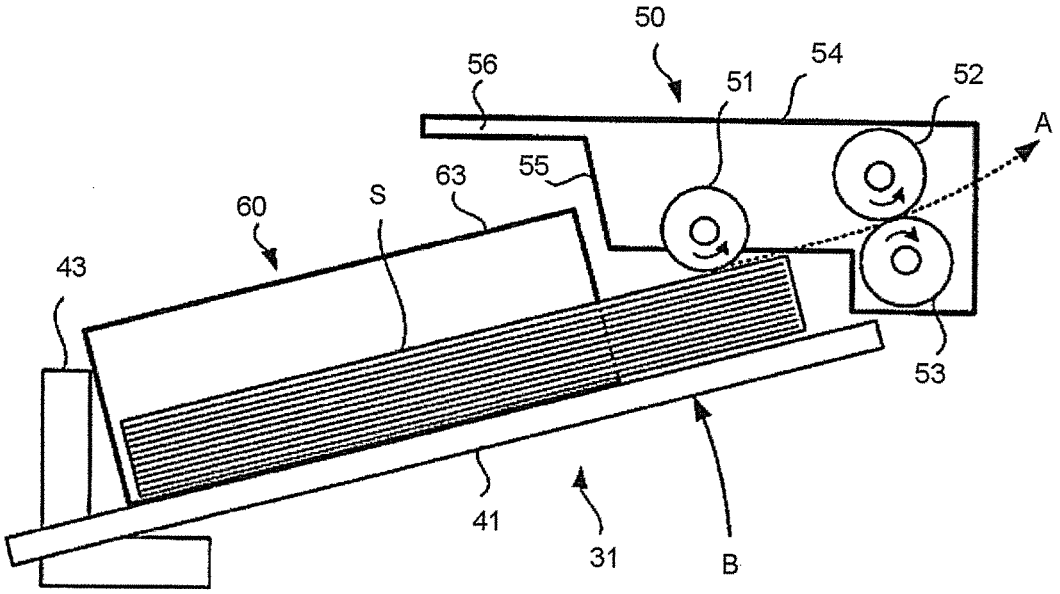
FIG. 5 is a side view illustrating the constitutions of the cassette and a paper feed section according to the embodiment.
Figure 6:
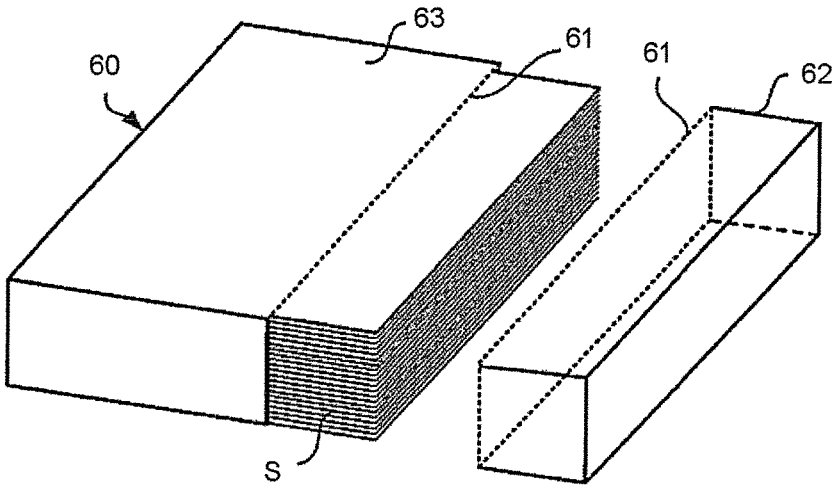
FIG. 6 is a perspective view illustrating an example of a packaging member of the papers according to the embodiment.

FIG. 5 is a side view illustrating the constitutions of the cassette 31 and a paper feed section 50 of the image forming apparatus according to the embodiment. FIG. 6 is a perspective view illustrating the constitution of a packaging member 60 for packaging the paper S.

As shown in FIG. 6, the paper S is stored in the packaging member 60 such as a wrapping paper and the like. An annular perforation 61 is put at a front end part of the packaging member 60 of a direction in which the paper S is conveyed. Further, the perforation 61 is only one example, and in addition to the perforation, the break such as slit and the like formed intermittently is put. In short, it is not limited to the perforation 61 and may be anything as long as it promotes the opening of the front end portion of the packaging member 60.

When the paper S is set in the cassette 31, the packaging member 60 opens a front end part 62 along the perforation 61. FIG. 6 shows a state in which the front end part 62 of the packaging member 60 is opened. After the front end part 62 is opened, the packaging member 60 is set on the tray 41 while the packaging member 60 stores the paper S in a main body part 63. After the front end part 62 of the packaging member 60 is removed, the end portion of the paper S is exposed from the opened end portion. Thus, the exposed end portion of the paper S is contacted with the pickup roller 51.

The main body part 63 after opening the front end part 62 is turned into a shape in order not to interfere with a sensing operation (light transmission) of the empty sensor 47. That is, the empty sensor 47 detects the existence/absence of the paper S exposed from the opened end portion of the packaging member 60.

In FIG. 5, the packaging member 60 of which the front end part 62 is removed is set on the tray 41. The front end of paper S stored in the main body part 63 of the packaging member 60 is contacted with the pickup roller 51.

The paper feed section 50 includes the pickup roller 51 for picking up the paper S from the cassette 31. Further, the paper feed section 50 includes paper feed rollers 52 and 53 for conveying the paper picked up by the pickup roller 51.

The pickup roller 51, which is contacted with the front end of the paper S on the tray 41, is rotated and picks up the paper S. The paper S picked up by the pickup roller 51 is sent to the paper feed rollers 52 and 53. When the papers more than or equal to two sheets are picked up by the pickup roller 51, the paper feed roller 53 separates the papers one by one and then conveys the separated paper. The paper feed roller 53 is also called as a separation roller. The paper feed rollers 52 and 53 are arranged to face each other. Through the rotation of the paper feed rollers 52 and 53, the paper S is conveyed in a direction indicated by an arrow A and conveyed to the conveyance roller 32 (FIG. 1).

The paper feed section 50 has a housing 54 in which the pickup roller 51 and the paper feed rollers 52 and 53 are mounted. A stopper 55 is arranged in the housing 54 at the side facing the cassette 31. The stopper 55 constitutes a regulating member for regulating that the packaging member 60 is conveyed from the tray 41. The stopper 55 is opposite to the main body part 63 of the packaging member 60.

A protrusion 56 is arranged at the upper portion of the stopper 55 so as to be opposite to the paper S and the packaging member 60.

As the paper S is fed sequentially from the cassette 31, the remaining amount of the papers is reduced. If the remaining amount of the papers is reduced and becomes only the final paper, there is a case in which the packaging member 60 is conveyed in a conveyance direction of the paper under the influence of the paper S. The stopper 55 is arranged to regulate that the packaging member 60 is conveyed. The protrusion 56 presses the end portion of the perforation 61 side of the packaging member 60.

If the paper S on the tray 41 is reduced, the tray 41 is operated up by the lever 45 (FIG. 4). The packaging member 60 is also up, but part of the perforation 61 is opposite to the stopper 55.

Thus, even if the packaging member 60 is conveyed from the tray 41 with the conveyance of the paper S, the front end (part of perforation 61) of the packaging member 60 hits the stopper 55. The packaging member 60 is regulated by the stopper 55, which prevents the packaging member 60 from being conveyed from the tray 41. The upper side of the part of the perforation 61 of the packaging member 60 is pressed to the stopper 55 side through the protrusion 56.

Figure 7:
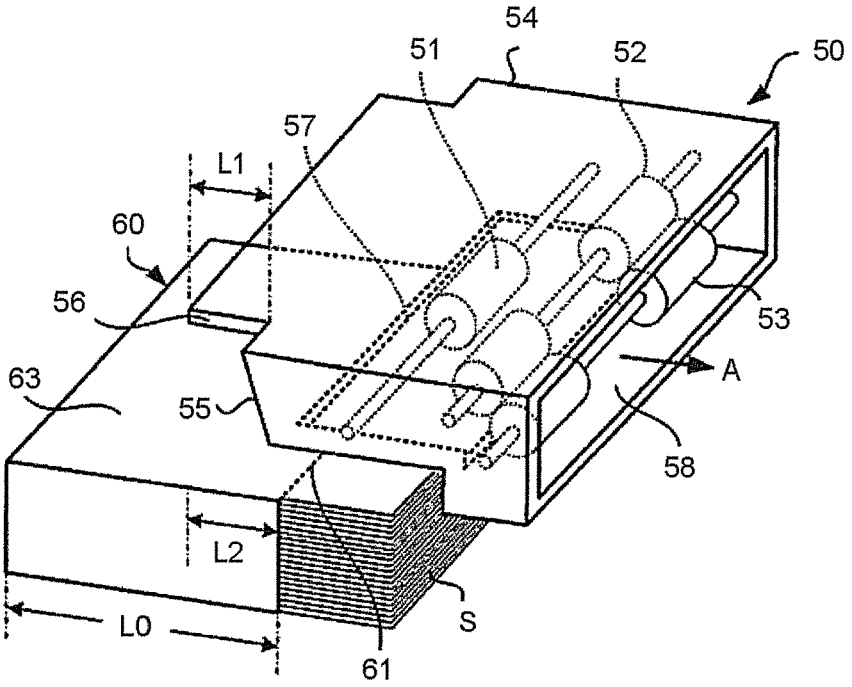
FIG. 7 is a perspective view illustrating the constitutions of the packaging member of the papers and the paper feed section according to the embodiment.

FIG. 7 is a perspective view illustrating the paper S stored in the paper feed section 50 and the packaging member 60. FIG. 7 shows a position relation of the paper feed section 50 and the packaging member 60 when the tray 41 is in a most lowered and fixed position.

As shown in FIG. 7, the paper feed section 50 rotatably mounts the pickup roller 51 and the paper feed rollers 52 and 53 inside the housing 54. An opening 57 is arranged at the bottom of the housing 54. The opening 57 is opposite to the front end portion of the paper S exposed from the packaging member 60. One part of the pickup roller 51 protrudes from the opening 57. If the tray 41 of the cassette 31 is lifted, the pickup roller 51 contacts with the paper S.

Rotation shafts of the paper feed rollers 52 and 53 are parallelly mounted in a position separated from the pickup roller 51 inside the housing 54. A paper discharge port 58 is arranged at the outlet side of the paper feed rollers 52 and 53 of the housing 54. The paper S picked up by the pickup roller 51 is discharged from the paper discharge port 58 in a direction indicated by an arrow A through the rotation of the paper feed rollers 52 and 53. The paper S discharged from the paper discharged port 58 is conveyed to the conveyance roller 32 (FIG. 1).

The stopper 55 of the housing 54 is arranged at the side facing the packaging member 60. The stopper 55 is inclined. The inclination angle of the stopper 55 is inclined along the circumference when one end of the tray 41 is rotated in a rise direction (direction indicated by an arrow B in FIG. 5). As shown in FIG. 5, if one end of the tray 41 is lifted, the stopper 55 is opposite to the main body part 63 of the packaging member 60.

The protrusion 56 is arranged integrally at the upper portion of the stopper 55 of the housing 54 and protrudes to be opposite to the paper S and the packaging member 60. The stopper 55 regulates that the packaging member 60 is conveyed with the conveyance of the paper S. The protrusion 56 presses the upper surface of the end portion of the perforation 61 side when one end of the tray 41 is rotated in a rise direction.

As shown in FIG. 7, when the paper is conveyed in a conveyance direction A, a width L1 of the protrusion 56 along the conveyance direction A is set to be a length for covering only a predetermined width L2 from the perforation 61 to the main body part 63 side of the packaging member 60. The width L2 is, for example, about ¼~½ of a width L0 of the main body part 63.

Figure 8:
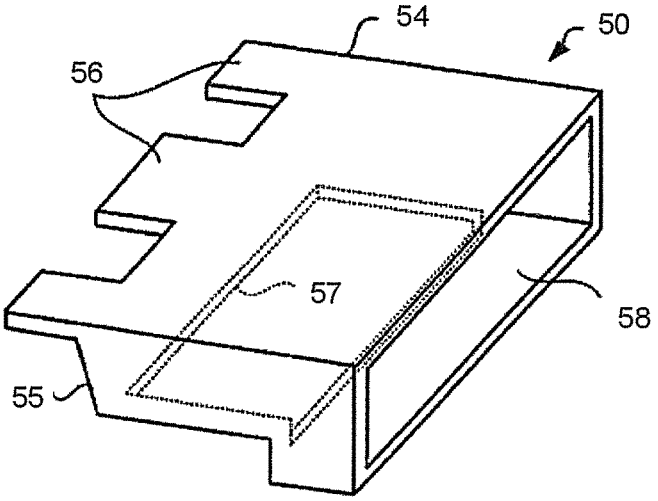
FIG. 8 is a perspective view illustrating a modification of a protrusion of the paper feed section according to the embodiment.

FIG. 8 is a perspective view illustrating a modification of the protrusion 56 of the paper feed section 50. The protrusion 56 in FIG. 8 is formed into a tooth shape of comb. The number of the teeth is randomly set, and the width and the interval of the teeth is also randomly set. The protrusion 56 of the tooth shape of comb may be any shape as long as the protrusion 56 can press the main body part 63 of the packaging member 60.

Figure 9A:
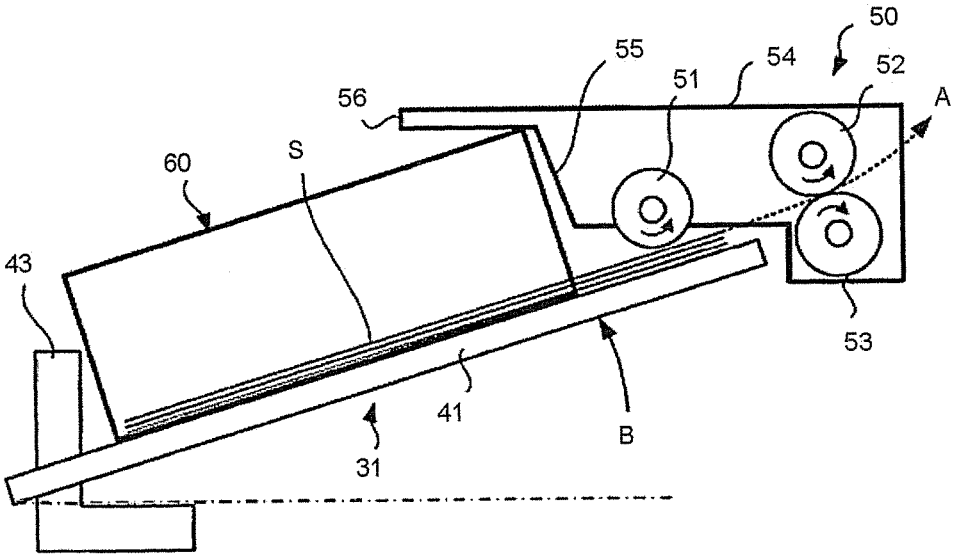
FIG. 9A is an illustration diagram illustrating a paper feed operation in a state in which a tray of the cassette is lifted according to the embodiment.
Figure 9B:
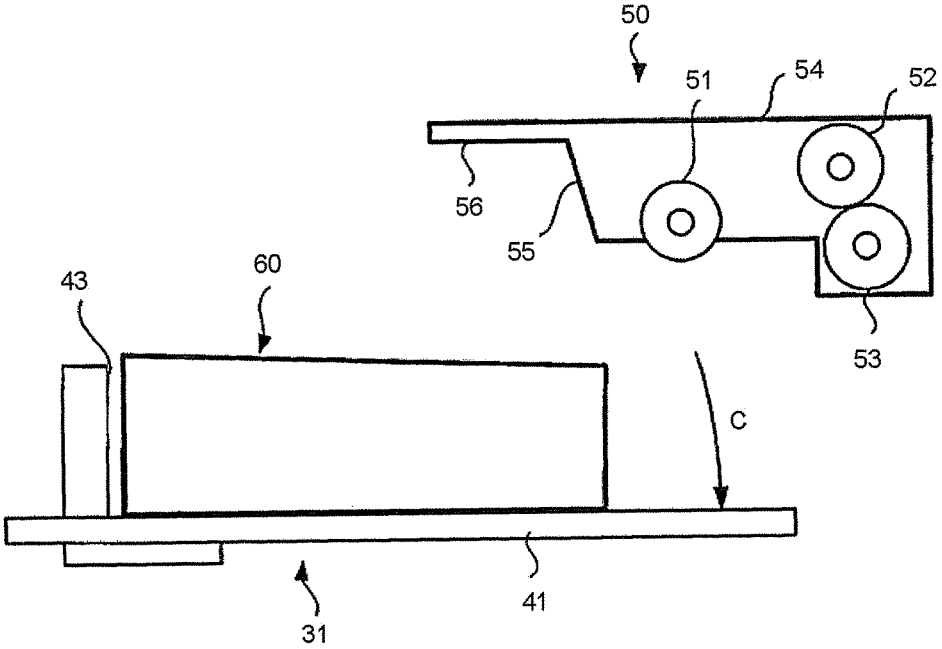
FIG. 9B is an illustration diagram illustrating the paper feed operation in a state in which the tray of the cassette is lowered according to the embodiment.

FIG. 9A and FIG. 9B are illustration diagrams illustrating the paper feed operation from the cassette 31. FIG. 9A shows a state in which one end of the tray 41 of the cassette 31 is lifted in a direction indicated by an arrow B. FIG. 9B shows a state in which one end of the tray 41 of the cassette 31 is lowered in a direction indicated by an arrow C.

As shown in FIG. 9A, as the paper S is fed sequentially from the cassette 31, the remaining remount of the papers S is reduced. If the remaining amount of the papers S is reduced, one end of the tray 41 is slowly lifted and the position of the packaging member 60 is also lifted. The end portion of the perforation 61 of the packaging member 60 hits the stopper 55 which can regulate that the packaging member 60 is conveyed together with the conveyance of the paper S. The upper side of the end portion of the perforation 61 of the packaging member 60 is pressed by the protrusion 56. That is, the end portion of the perforation 61 of the packaging member 60 dives under the protrusion 56 along the surface of the inclination of the stopper 55. Therefore, the end portion of the perforation 61 of the packaging member 60 is not caught on the stopper 55.

On the other hand, as shown in FIG. 9B, if the paper is in an empty state, the tray 41 is lowered to a fixed position. If the tray 41 is lowered, the packaging member 60 is lowered together with the tray 41, so if the cassette 31 is pulled out from the main body 101, the packaging member 60 is also pulled out. Thus, the packaging member 60 is not blocked in the cassette 31.

Figure 10A:
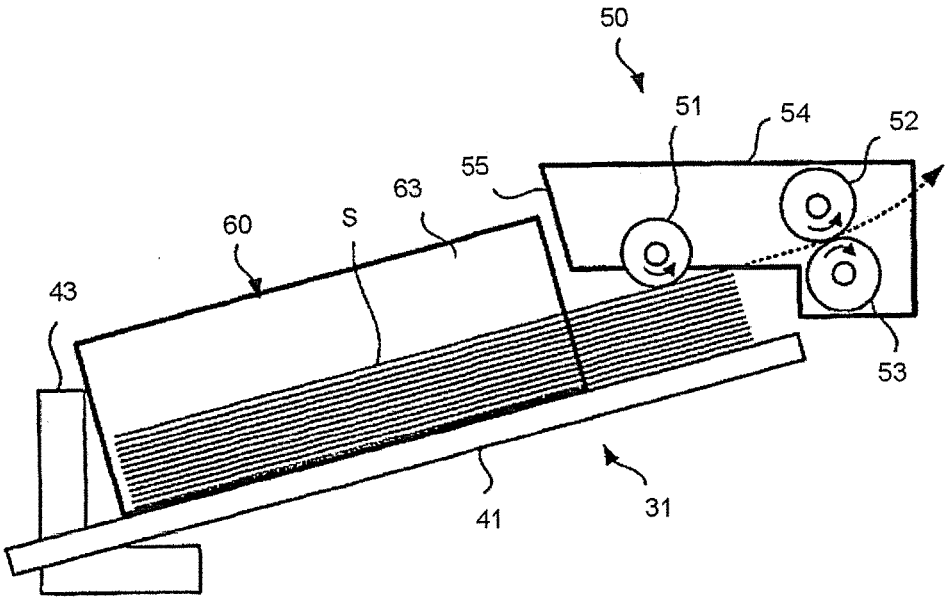
FIG. 10A is an illustration diagram illustrating the paper feed operation in a case in which there is no protrusion in the paper feed section.
Figure 10B:
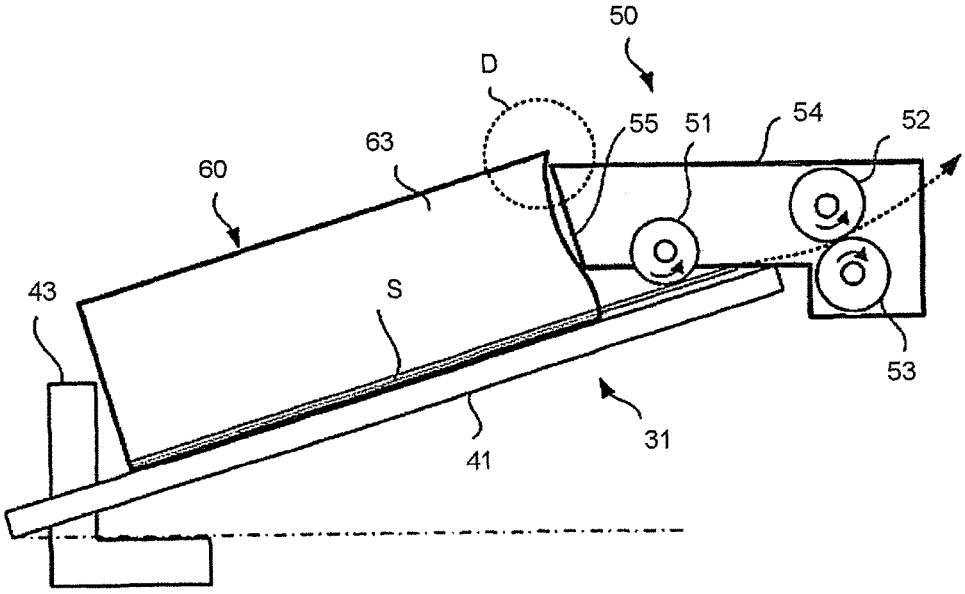
FIG. 10B is an illustration diagram illustrating the other example of the paper feed operation in a case in which there is no protrusion in the paper feed section.

FIG. 10A and FIG. 10B are diagrams illustrating the meaning of existence of the protrusion 56. That is, FIG. 10A and FIG. 10B are illustration diagrams illustrating the paper feed operation in a case in which there is no protrusion 56 in the paper feed section 50. FIG. 10A shows a state in which the remaining amount of the papers S is about half. FIG. 10B shows a state in which the remaining amount of the paper is less.

As shown in FIG. 10A, even if there is no protrusion 56, the packaging member 60 hits the stopper 55. Thus, the packaging member 60 can be prevented from being conveyed together with the conveyance of the paper S. However, if the remaining amount of the papers is reduced and the tray 41 is further lifted, the position of the packaging member 60 is also lifted. In this state, as shown in a circle D of FIG. 10B, the front end of the stopper 55 enters inside the perforation 61 of the packaging member 60.

If the front end of the stopper 55 enters inside the packaging member 60, the packaging member 60 is caught on the stopper 55. Moreover, if the paper is in an empty state and the tray 41 is lowered to a fixed position (position of dashed line of FIG. 10B), the packaging member 60 is caught on the stopper 55 and is not able to fall together with the tray 41. Thus, even if the cassette 31 is pulled out from the main body 101, the packaging member 60 can not be pulled out. If the packaging member 60 is not pulled out, the packaging member 60 is blocked in the cassette 31, which is the reason of failure.

In the embodiment, the protrusion 56 is arranged at the upper end of the stopper 55, therefore the end portion of the perforation 61 of the packaging member 60 is pressed by the protrusion 56 as described in FIG. 9A. Therefore, the upper end of the stopper 55 does not enter inside the perforation 61 of the packaging member 60 and the packaging member 60 is not caught on the stopper 55. Thus, when the paper is in an empty state and the tray 41 is lowered, the packaging member 60 can fall together with the tray 41. If pulling out the cassette 31, the packaging member 60 can be pulled out together with the cassette 31.

In accordance with the image forming apparatus according to the embodiment described above, the paper with the packaging member can be set in the cassette. Thus, the setting of the paper can be carried out simply without troubling the user. The setting failure of the paper does not occur, and position deviation of the image formed on the paper or paper jam can be reduced. Moreover, that the packaging member is conveyed can be regulated by the stopper, and the packaging member can be prevented from being blocked in the cassette.

(Second Embodiment)

Figure 11A:
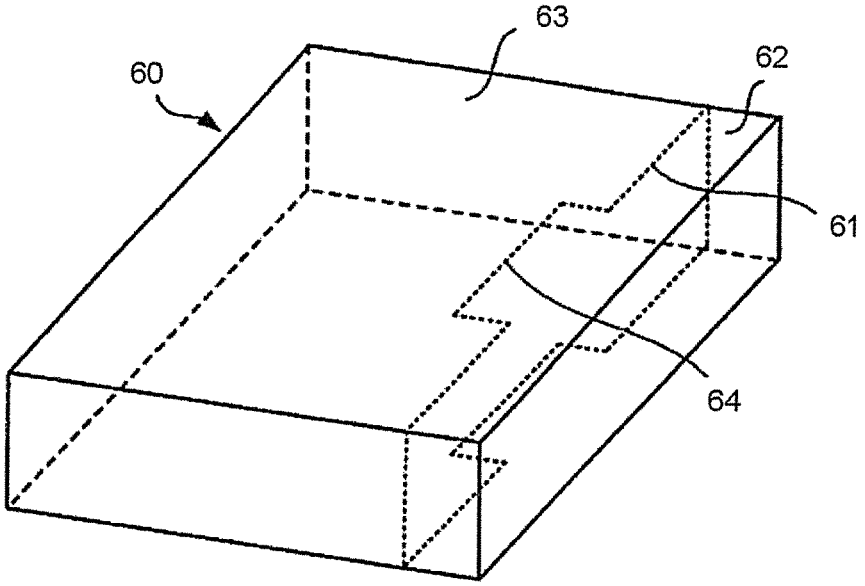
FIG. 11A is a perspective view illustrating a modification of a packaging member of the paper according to the embodiment.
Figure 11B:
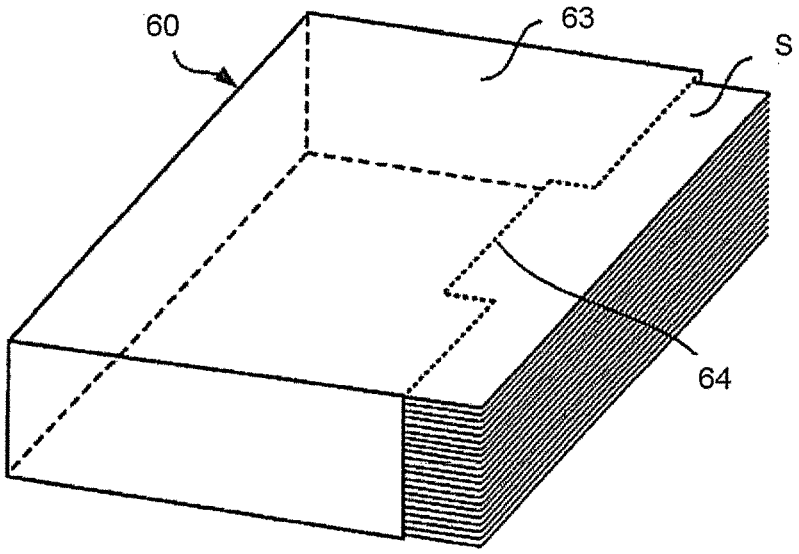
FIG. 11B is a perspective view illustrating a state in which a font end portion of the packaging member of the modification.

FIG. 11A and FIG. 11B show the other modification of the packaging member 60. The shape of the perforation 61 of the front end part of the packaging member 60 in FIG. 11A is slightly different from that in FIG. 6. That is, the perforation 61 is formed to reduce the opening amount, and a perforation 64 is formed such that the centre of the perforation 61 is cut in a direction opposite to the conveyance direction A of the paper S. When setting the paper S in the cassette 31, the front end part 62 of the packaging member 60 is opened along the perforations 61 and 64.

FIG. 11B shows a state in which the front end part 62 is opened along the perforations 61 and 64. The front end part of the paper S is exposed. The part corresponding to the perforation 64 makes the exposure of the paper S large. The part forming the perforation 64 corresponds to the pickup roller 51.

In this way, the opening amount is reduced and the inclination of the paper conveyance can be suppressed. That is, the packaging member 60 has a role for guiding the paper S. The longer the distance at which the packaging member 60 guides the paper S is, the longer the distance at which the paper S is regulated is. Thus, if the distance at which the paper S is regulated is longer, it is possible to suppress the inclination at the time of the paper conveyance.

Further, it is not limited to the embodiment described above, and various applications are possible. For example, the shape of the protrusion 56 is not limited to the example illustrated and may be the other shapes. The shape of the perforation formed on the packaging member is not limited to the example illustrated and may be the other shapes.

The image forming apparatus according to the embodiment can be applied to an image forming apparatus of which the type is different from that in FIG. 1. For example, it may be an image forming apparatus which has a plurality of developing units for color like a 4-tandem type. The exposure unit 13 having the laser light source can be replaced by a scanning head including LED elements.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a cassette for paper feed configured to include a tray capable of stacking papers as stored in a packaging member, the packaging member has an end portion which is opened prior to the packaging member being placed on the tray;

a paper feed section configured to include a pickup roller arranged correspond to an opened end portion of the packaging member placed on the tray which pick up the papers stored in the packaging member from the packaging member;

a driving section configured to lift the tray of the cassette to the pickup roller side according to the reduction of remaining amount of papers stacked on the tray of the cassette;

a regulating member configured to regulate that the packaging member to be conveyed together with the papers, when the papers are fed from the tray of the cassette by the paper feed section;

a protrusion configured to arrange at the regulating member, the protrusion formed protrude from an upper portion of the regulating member in an opposite direction of a conveyance direction of the papers by a predetermined width, and to press an upper side of the opened end portion of the packaging member when the tray of the cassette is lifted; and an image forming section configured to form an image on the paper conveyed by the paper feed section.

2. The image forming apparatus according to claim 1, wherein the predetermined width (L1) of the protrusion is set a quarter to a half of a width (L0) of a main body part of the packaging member along the conveyance direction of the papers.

3. The image forming apparatus according to claim 2, wherein the protrusion is formed into a teeth shape of comb.

4. The image forming apparatus according to claim 1, further comprising:

a housing in which the pickup roller is mounted, wherein the regulating member is a stopper mounted to the housing and arranged in a position opposite to the opened end portion of the packaging member.

5. The image forming apparatus according to claim 4, wherein one end of the tray of the cassette is located nearest the pickup roller, and the tray of the cassette is rotated by taking another end as a fulcrum; and the stopper has a slope inclined along a circumference formed by the one end of the tray is rotated about the fulcrum.

6. The image forming apparatus according to claim 1, wherein the cassette can be stored in a main body of the image forming apparatus; and the one end of the tray of the cassette is disconnect from the driving section and lowered along with an empty packaging member to a fixed position through a self-weight of the tray, when the cassette is pulled out from the main body.

7. The image forming apparatus according to claim 1, further comprising:

an empty sensor arranged correspond to the opened end portion of the packaging member placed on the tray, and configured to detect that there is no paper on the tray of the cassette, the driving section lowers the one end of the tray of the cassette along with an empty packaging member to a fixed position responsive to a detection result of the empty sensor when there is no paper on the tray.

8. The image forming apparatus according to claim 7, wherein the empty sensor arranged as detects the paper exposed from the opened end portion of the packaging member placed on the tray, thereby the main body part of the packaging member does not interfere with a paper detecting operation of the empty sensor.

9. The image forming apparatus according to claim 1, wherein an annular and intermittent break is formed at one end portion of the packaging member to promote the opening of the one end portion.

10. The image forming apparatus according to claim 9, wherein the annular break is formed at the one end portion of the packaging member to reduce an opening amount, and a center portion of the break corresponding to the pickup roller is cut slightly in a direction opposite to the conveyance direction of the papers; and the packaging member guides the papers in the conveyance direction after the one end portion is opened.

* * * * *